US006290535B1

(12) United States Patent
Lin et al.

(10) Patent No.: US 6,290,535 B1
(45) Date of Patent: Sep. 18, 2001

(54) SHIELDED ELECTRICAL CONNECTOR

(75) Inventors: Tai Lin, Shu-Lin; Kun-Tsan Wu, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/222,440

(22) Filed: Dec. 28, 1998

(30) Foreign Application Priority Data

Jun. 10, 1998 (TW) ..... 87209169 U

(51) Int. Cl.[7] ..... H01R 13/66
(52) U.S. Cl. ..... 439/541.5; 439/607
(58) Field of Search ..... 439/92, 799, 939, 439/947, 540.1, 607; 174/51; 361/753

(56) References Cited

U.S. PATENT DOCUMENTS 5,735,699 * 4/1998 Tan et al. ..... 439/92
5,797,770 * 8/1998 Davis et al. ..... 439/607
5,865,645 * 2/1999 Embo et al. ..... 439/567
5,908,331 * 6/1999 Hsu et al. ..... 439/607

* cited by examiner

*Primary Examiner*—Brian Sircus
*Assistant Examiner*—J. F. Duverne
(74) *Attorney, Agent, or Firm*—Wei Te Chung

(57) ABSTRACT

An electrical connector (10) comprises an insulative housing (20) having a D-sub receptacle (30) and an audio jack (40) mounted thereto, and a metal shell (50) assembled to the housing (20). Grounding legs (28) of the board locks (26) downwardly extend from the housing (20) for engaging with ground traces on a PCB and groundingly clips (43) protrude from a front face of the audio jack (40) for contacting a computer enclosure whereby accumulated charges on the connector (10) can be effectively discharged. The shell (50) shields the connector (10) from being adversely affected by external charges and prevents internal electromagnetic waves of the connector (10) from radiating externally by creating other grounding routes for electrical discharge. The shell (50) can be assembled to the connector (10) either before or after the connector (10) is mounted on a PCB.

7 Claims, 6 Drawing Sheets

SHIELDED ELECTRICAL CONNECTOR

BACKGROUND OF THE INVENTION

1. Field of the Invention

The present invention relates to an electrical connector, and particularly to a shielded electrical connector having a metal shell exhibiting excellent shielding and grounding effects.

2. The Related Art

For presently used electrical connectors, accumulated charges on the connector resulting from interference are commonly discharged through grounding legs thereof but electromagnetic waves generated from within the connector are allowed to radiate randomly. With an increasingly larger quantity of signals being transmitted at an increasingly higher transmission rate, the grounding route of such connectors cannot meet the demand.

U.S. Pat. No. 5,735,699, which is assigned to the same assignee as the present invention, discloses an electrical connector having grounding legs downwardly extending from a housing thereof for engaging with ground traces on a PCB and grounding clips protruding from a front face thereof for contacting a computer enclosure whereby accumulated charges thereon can be effectively discharged. However, electromagnetic waves generated from within the connector are not properly shielded.

As is known, a metal shell can shield external charges and prevent internal electromagnetic waves from radiating externally whereby grounding routes can expel charges more quickly thereby providing a more reliable transmission of electrical signals. Hence, the connector requires a shell to overcome the problems of electromagnetic interference.

SUMMARY OF THE INVENTION

Accordingly, an objective of the present invention is to provide a shielded connector having excellent shielding and grounding features.

An electrical connector in accordance with one aspect of the present invention comprises an insulative housing having a D-sub receptacle and an audio jack mounted thereto, and a metal shell assembled to the housing. Grounding legs of board locks downwardly extend from the housing for engaging with ground traces on a PCB and grounding clips protrude from a front face of the audio jack for contacting a computer enclosure whereby accumulated charges on the connector can be effectively discharged. The shell shields the connector from being adversely affected by external charges and prevents internal electromagnetic waves of the connector from radiating externally by creating other grounding routes for electrical discharge. The shell comprises a first section and a second section assembled to the connector after the connector is mounted on a PCB.

According to another aspect of the present invention, the first and second sections of the shell are integrally formed together whereby the shell can be assembled to the connector before the connector is mounted to a PCB.

These and additional objects, features, and advantages of the present invention will become apparent after reading the following detailed description of the preferred embodiments of the present invention taken in conjunction with the appended drawing figures.

DETAILED DESCRIPTION OF THE PREFERRED EMBODIMENTS

Figure 1:
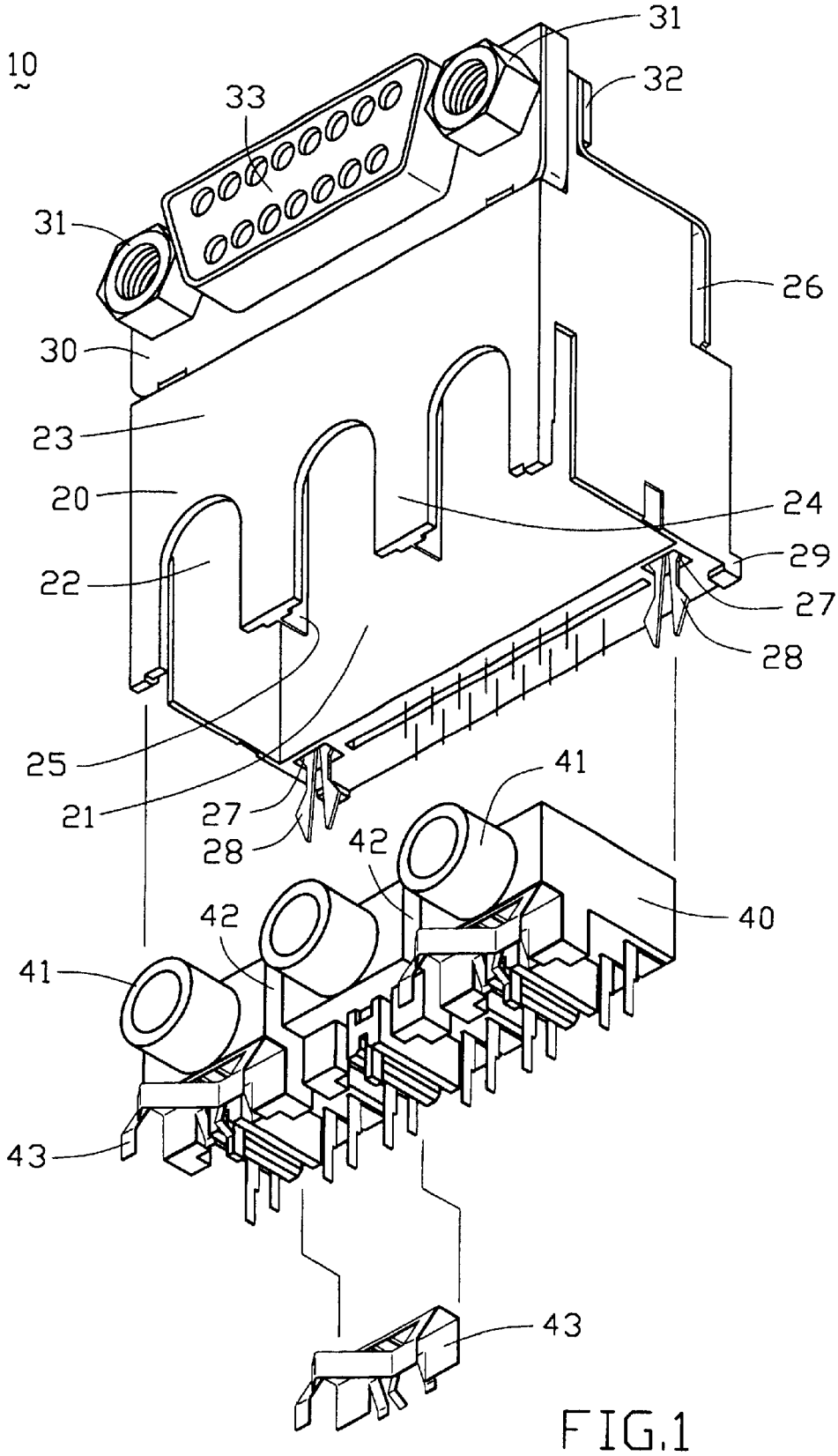
FIG. 1 is an exploded view of an electrical connector to which a metal shell of the present invention is to be applied.

References will now be made in detail to the preferred embodiments of the invention. For better understanding, most of like components are designated by like reference numerals throughout the various figures in the embodiments.

Referring to FIG. 1, a connector 10 in accordance with the present invention comprises an insulative housing 20 , a D-sub receptacle 30 mounted to a top portion of the housing 20 by means of engagement between metal fasteners 31 and rivets 32 at opposite ends thereof, and an audio jack 40 mounted to a bottom portion of the housing 20. The housing 20 defines a cavity 21 for receiving the audio jack 40 therein and three slots 22 in a front plate 23 thereof for each slidably receiving a mating port 41 of the audio jack 40. Partitions 24 between adjacent slots 22 each form a thin protrusion 25 extending into the cavity 21 of the housing 20 for engaging with slits 42 defined in a front face of the audio jack 40. A pair of board locks 26 are attached to a rear face of the D-sub receptacle 30 by the engagement between the metal fasteners 31 and the rivets 32. The board locks 26 extend through channels 27 defined in a rear portion of the housing 20. Grounding legs 28 formed at ends of the board locks 26 downwardly extend from the housing 20 for engaging with ground traces on a PCB (not shown) and grounding clips 43 protrude from a front face of the audio jack 40 for contacting a computer enclosure (not shown) whereby accumulated charges on the connector 110 can be effectively discharged. However, elctromagnetic waves generated from within the connector 10 are not properly shielded.

Figure 2:
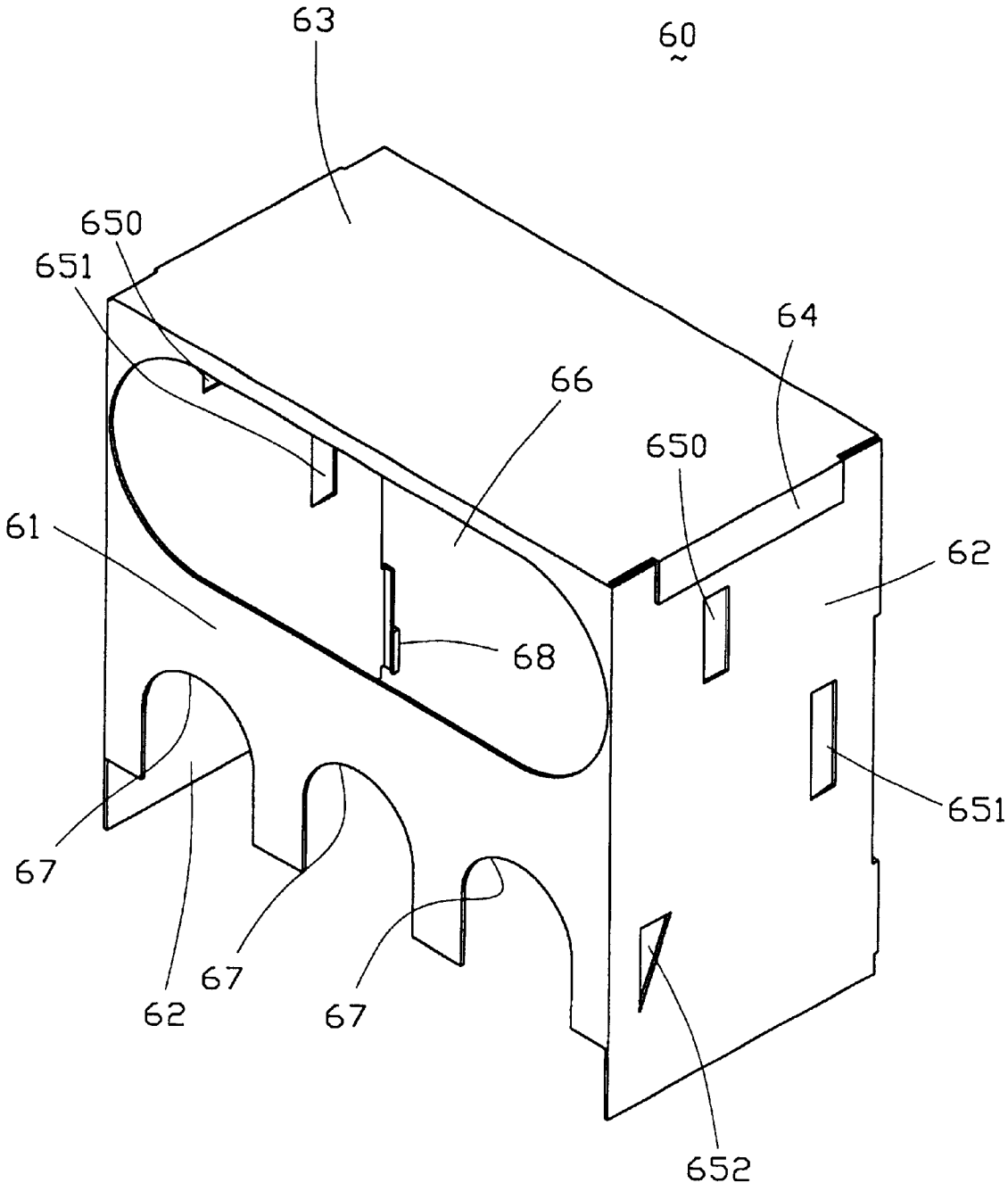
FIG. 2 is a perspective view of a first section of the shell in accordance with a first embodiment of the present invention.
Figure 3:
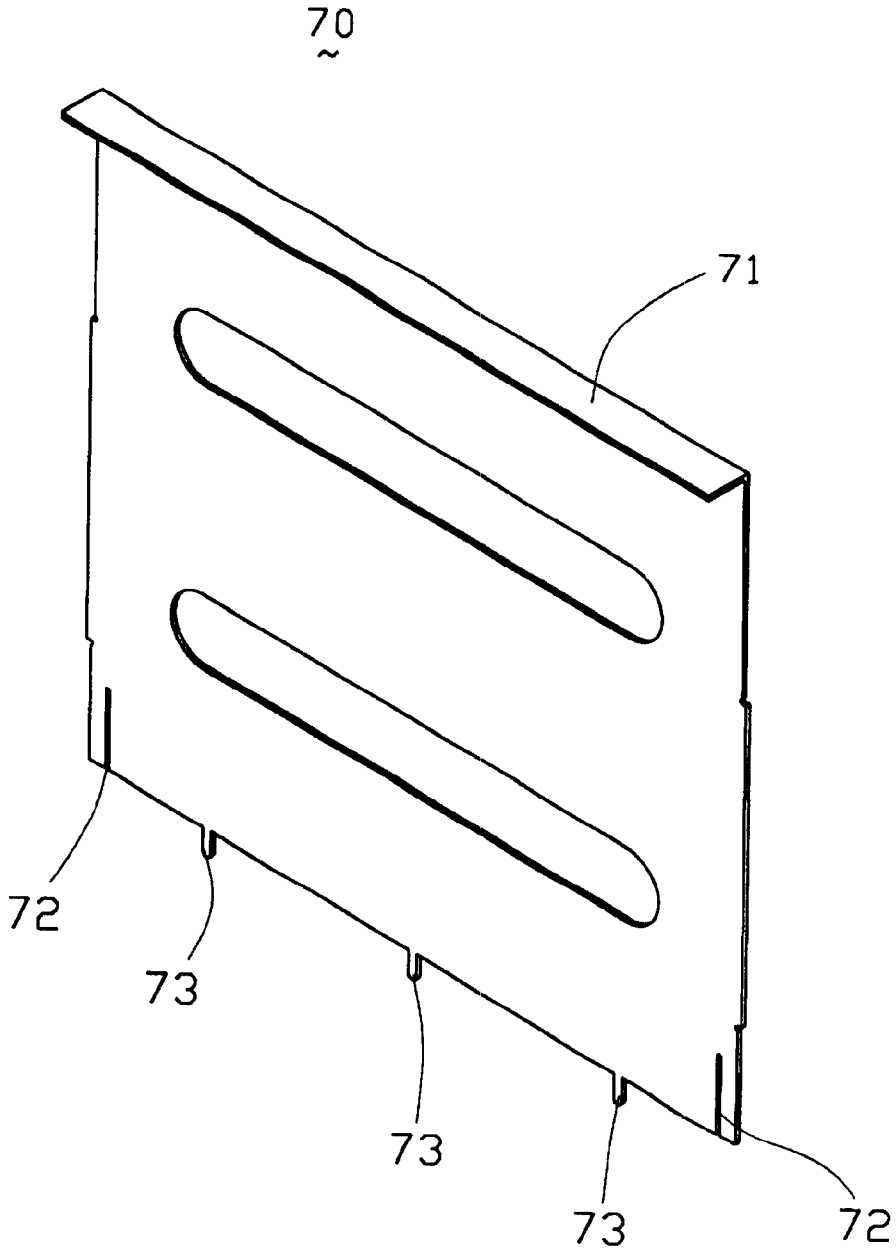
FIG. 3 is a perspective view of a second section of the shell in accordance with the first embodiment of the present invention.

A metal shell 50 (FIG. 4) in accordance with a first embodiment of the present invention is provided to shield the connector 10 from being adversely affected by external charges and prevent internal electromagnetic waves from radiating externally. The shell 50 comprises a first section 60 (FIG. 2) and a second section 70 (FIG. 3). Referring to FIG. 2, the first section 60 of the shell 50 comprises a front face 61, two side faces 62, and a top face 63. The top face forms folds 64 on outer edges, thereof for strengthening engagement with the side faces 62. Each side face 62 forms a first connecting tab 650, a second connecting tab 651, and a third connecting tab 652. The connecting tabs 650, 651, 652 are formed by a stamping process to extend into an interior of the shell 50. The front face 61 defines an opening 66 and three notches 67 therein. Protrusions 68 extend inward from a bottom portion of rear edges of each side face 62. As seen in FIG. 3, the second section 70 forms a flange 71 along a top edge thereof. A pair of slits 72 is defined proximate cistal ends of a bottom edge thereof. Three pins 73 extend from the-bottom edge.

Figure 4:
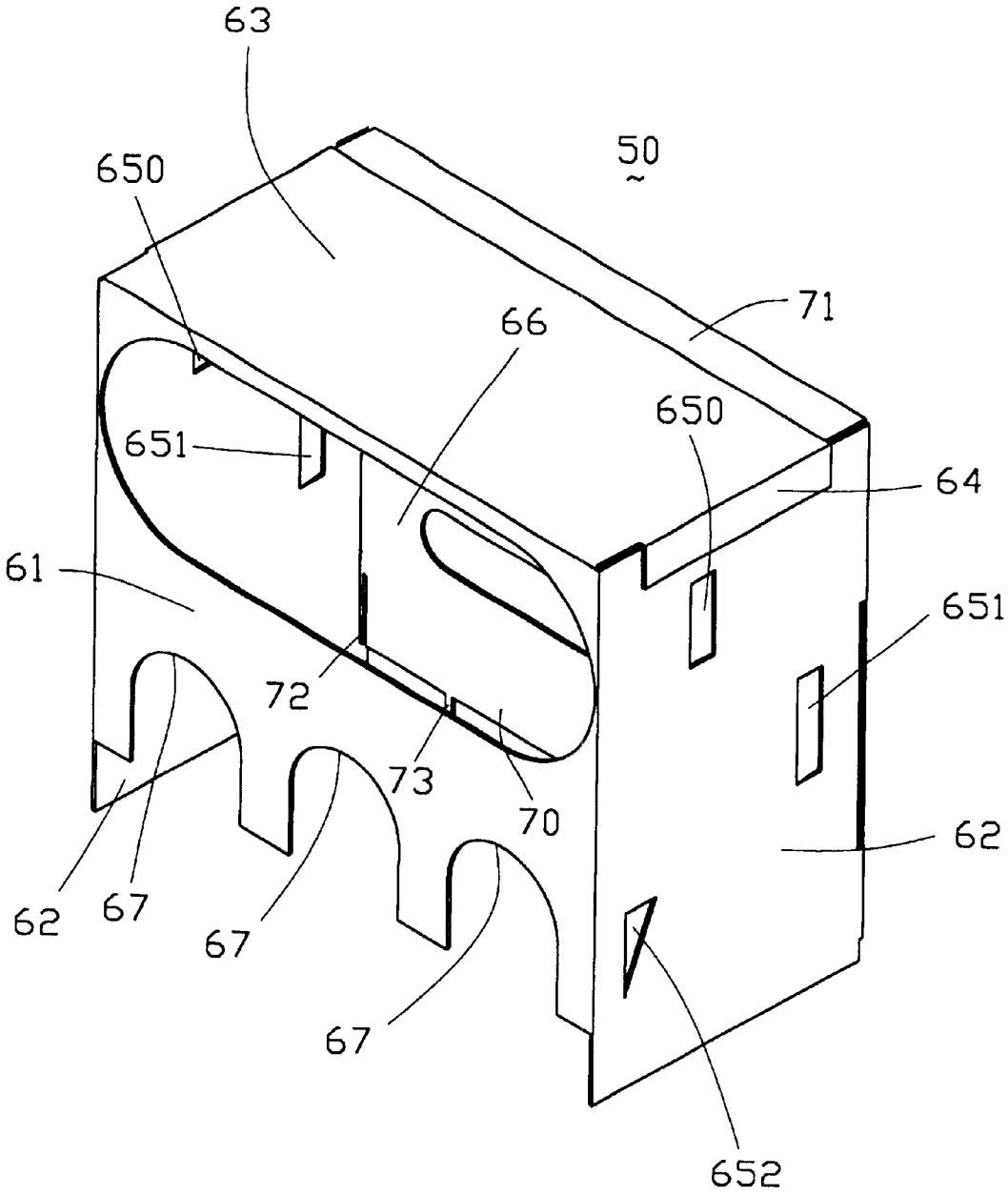
FIG. 4 is a perspective view of the shell of the present invention wherein the first and second sections are assembled together.

Referring to FIGS. 1 and 4, after the connector 10 is mounted on a PCB (not shown), the shell 50 can be assembled thereto. The first section 60 of the shell 50 is attached to the front plate 23 of the housing 20. The mating ports 41 of the audio jack 40 and a protruding block 33 of the D-sub receptacle 30 extend through the corresponding notches 67 and opening 66 of the first section 60, respectively. The first connecting tabs 650 of the first section 60 of the shell 50 contact a portion of the board lock 26 or the rivet 32 thereby constituting a first grounding route. The second connecting tabs 651 contact a different portion of the board lock 26 thereby constituting a second grounding route. As is evident, the second grounding route is shorter than the first grounding route. The third connecting tabs 652 contact the grounding clip 43 of the audio jack 40. The second section 70 of the shell 50 is assembled to the first section 60 of the shell 50 whereby the flange 71 rests on a rear edge of the top face 63 of the first section 60 thereby retaining the top face 63 in position. The protrusions 68 of the first section 60 engage with the slits 72 of the second section and the pins 73 of the second section 70 are securely received in holes (not shown) defined in a rearwardly protruding edge 29 of the housing 20.

Figure 5:
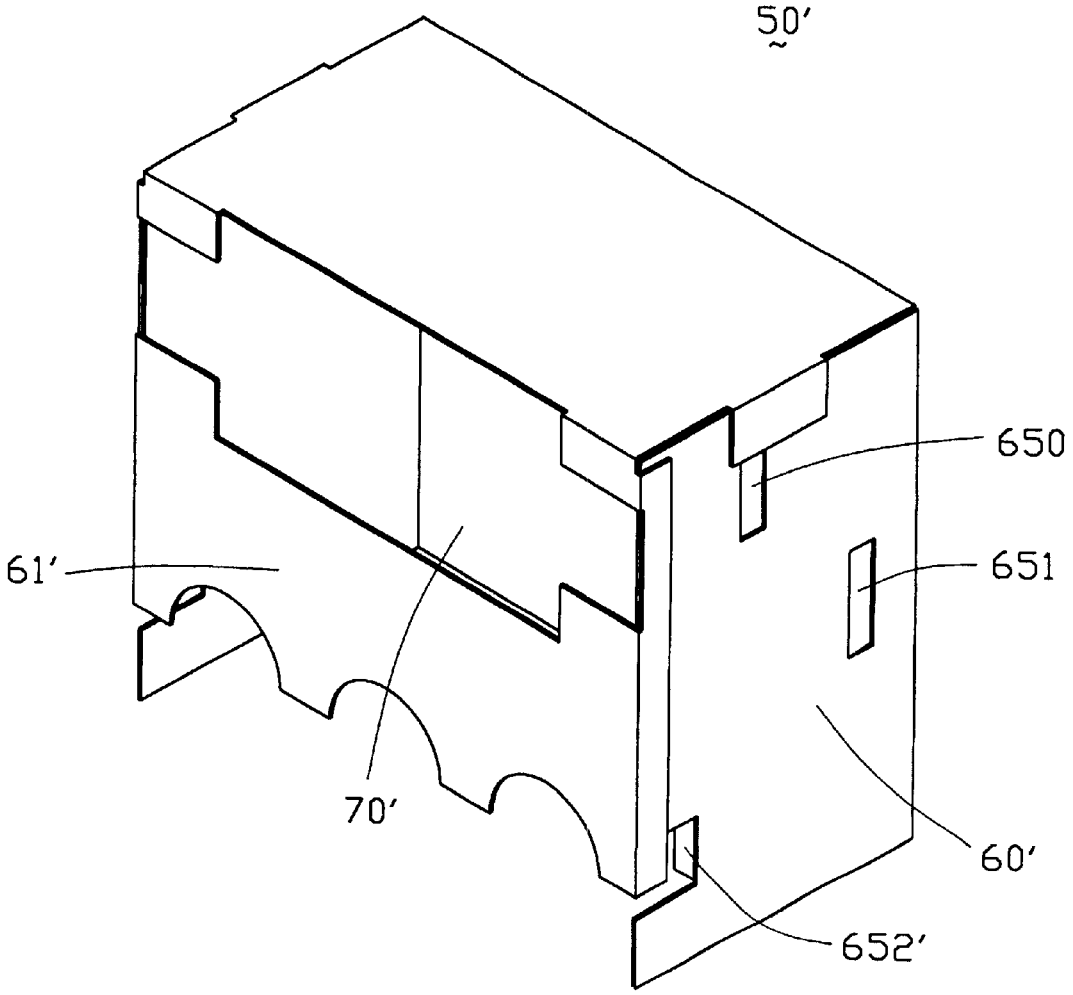
FIG. 5 is a perspective view of the shell in accordance with a second embodiment of the present invention.
Figure 6:
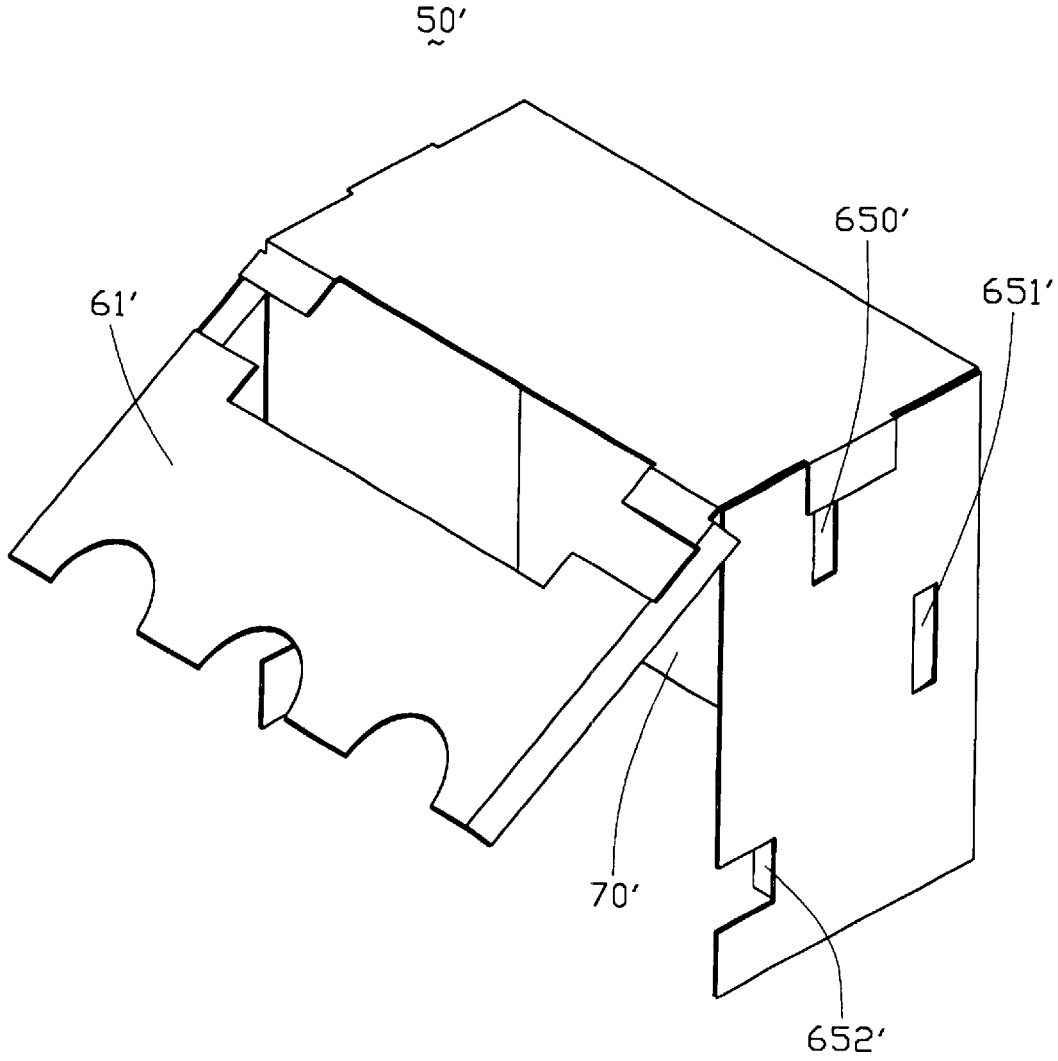
FIG. 6 is an operational view of FIG. 5.

A second embodiment of a shell 50' in accordance with the present invention is shown in FIGS. 5 and 6. The structure of the second embodiment differs from the first embodiment in that first and second sections 60', 70' of the shell 50' are integrally formed together whereby the shell 50' can be assembled to the connector 10 before the connector 10 is mounted to a PCB. The shell 50' is assembled to the connector 10 and the front face 61' is bent downward to contact the front plate 23 of the connector 10. The purpose and function of the second embodiment of the shell 50' is the same as the first embodiment thereof.

It can be noted that the shell 50 is properly dimensioned to comply with the connector 10 and can be retained to the connector 10. through engagement between connecting tabs 650, 651, 652 and the corresponding portions of the connector 10.

The feature of the invention is to provide a two-story connector assembly with shield means wherein the shield means not only prevents incoming and out going electromagnetic interference of the connector assembly, but also efficiently and quickly removes the accumulated charges on the shield means and/or the connector assembly through either a first grounding path, i.e., a boardlock of the upper level D-Sub connector, or a second grounding path, i.e., a grounding clip of the lower level audio jack. Additionally, the shield means defines a front face, two side faces, a top face and a rear face wherein the front face includes an large upper opening and three small lower notches for allowing extension of the D-Sub connector and the audio jack, and the side faces define means adapted to engage with either the boardlock of the D-sub connector or the grounding clip of the audio jack for grounding.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, persons of ordinary skill in this field are to understand that all such equivalent structures are to be included within the scope of the following claims.

What is claimed is:

1. An electrical connector, comprising:

an insulative housing defining a cavity therein;

a D-sub receptacle attached to the housing;

an audio jack received in the cavity of the housing and attached thereto;

at least one board lock attached to the D-sub receptacle and downwardly extending from the housing; and a metal shell assembled to the housing and shielding the D-sub receptacle and the audio jack, said metal shell comprising a first section and a second section, the first section comprising a front face, two side faces, and a top face, the second section forming a flange along a top edge thereof for resting on a rear edge of the top face of the first section thereby retaining the top face in position;

whereby charges accumulated on the connector can be effectively discharged through the at least one board lock, and the shell shields the connector from being adversely affected by external charges and prevents internal electromagnetic waves from radiating externally; wherein a grounding clip protrudes from a front face of the audio jack for contacting a computer enclosure for providing the connector with another grounding path; wherein each side face of the first section of the metal shell forms a first connecting tab, and a second connecting tab, and a third connecting tab whereby the tabs extend from each side face of the first section into an interior of the shell, each first connecting tab contacting a portion of the at least one board lock, each second connecting tab contacting a different portion of the at least one board lock, and each third connecting tab contacting the grounding clip of the audio jack thereby providing the connector with additional grounding paths.

2. The connector as described in claim 1, wherein the top face of the first section of the shell forms folds on lateral outer edges thereof for strengthening engagement with the side faces thereof.

3. The connector as described in claim 1, wherein the second section of the shell forms a flange along a top edge thereof for resting on a rear edge of the top face of the first section thereby retaining the top face in position.

4. The connector as described in claim 1, wherein protrusions inwardly extend from rear edges of each side face of the first section of the shell for engaging with corresponding slits defined in a bottom edge of the second section.

5. The connector as described in claim 1, wherein at least on pin extends from a bottom edge of the second section for being securely received in a corresponding hole defined in a rearwardly protruding edge of the housing.

6. The connector as described in claim 1, wherein the shell can be assembled to the connector after the connector is mounted on the PCB.

7. The connector as described in claim 1, wherein the first and second sections of the shell are integrally formed together whereby the shell can be assembled to the connector before the connector is mounted to the PCB.

* * * * *